US009382874B2

(12) United States Patent
Steiner et al.

(10) Patent No.: US 9,382,874 B2
(45) Date of Patent: Jul. 5, 2016

(54) THERMAL ACOUSTIC PASSAGE FOR A STIRLING CYCLE TRANSDUCER APPARATUS

(75) Inventors: Thomas Walter Steiner, Burnaby (CA); Briac Medard de Chardon, Vancouver (CA); Takao Kanemaru, Port Coquitlam (CA)

(73) Assignee: Etalim Inc., Burnaby, BC (CA)

( * ) Notice: Subject to any disclaimer, the term of this patent is extended or adjusted under 35 U.S.C. 154(b) by 440 days.

(21) Appl. No.: 13/885,871

(22) PCT Filed: Nov. 10, 2011

(86) PCT No.: PCT/CA2011/001256

§ 371 (c)(1),
(2), (4) Date: May 16, 2013

(87) PCT Pub. No.: WO2012/065245

PCT Pub. Date: May 24, 2012

(65) Prior Publication Data

US 2013/0239564 A1 Sep. 19, 2013

Related U.S. Application Data

(60) Provisional application No. 61/415,196, filed on Nov. 18, 2010.

(51) Int. Cl.

| | |
|---|---|
| ***F02G 1/057*** | (2006.01) |
| ***F02G 1/043*** | (2006.01) |
| ***F02G 1/053*** | (2006.01) |

(52) U.S. Cl.

CPC ..... *F02G 1/057* (2013.01); *F02G 1/043* (2013.01); *F02G 1/053* (2013.01); *F02G 2257/00* (2013.01)

(58) Field of Classification Search

CPC ..... F02G 1/04; F02G 1/043; F02G 1/044; F02G 1/053; F02G 1/057; F02G 2257/00; F28D 17/00–17/04; F28D 19/00–19/048; F28D 20/023

USPC ..... 60/516–526

See application file for complete search history.

(56) References Cited

U.S. PATENT DOCUMENTS

| | | | |
|---|---|---|---|
| 3,548,589 A | 12/1970 | Cooke-Yarborough | |
| 3,802,196 A | 4/1974 | Franklin | |

(Continued)

FOREIGN PATENT DOCUMENTS

| | | | |
|---|---|---|---|
| DE | 3931312 A1 | 3/1991 | |
| EP | 0543132 A1 * | 5/1993 | ..... F02G 1/055 |

(Continued)

OTHER PUBLICATIONS

International Search Report, dated Nov. 9, 2010 from PCT Application No. PCT/CA2010/001092, entitled "Stirling Cycle Transducer for Converting Between Thermal Energy and Mechanical Energy," filed Jul. 12, 2010.

(Continued)

*Primary Examiner* — Jesse Bogue
*Assistant Examiner* — Laert Dounis
(74) *Attorney, Agent, or Firm* — McDermott Will and Emery LLP

(57) ABSTRACT

A communication passage in a Stirling cycle transducer includes a cylindrical shaped thermal regenerator providing flow paths aligned with a regenerator cylindrical axis for providing periodic gas flow between first and second interfaces of the regenerator. A first heat exchanger conveys gas between a periphery of the heat exchanger and the first interface causing a change of direction of gas flow between radially and axially oriented flow within the regenerator and transfers heat between the gas and an external environment in a direction aligned with the regenerator cylindrical axis. A second heat exchanger conveys gas between a periphery of the heat exchanger and the second interface causing a change of direction of gas flow between radially and axially oriented flow within the regenerator and transfers heat between the external environment and the gas in a direction aligned with the regenerator cylindrical axis.

31 Claims, 6 Drawing Sheets

(56) References Cited

U.S. PATENT DOCUMENTS

| | | | | |
|---|---|---|---|---|
| 3,805,527 | A | 4/1974 | Cooke-Yarborough et al. | |
| 3,834,455 | A * | 9/1974 | Hakansson | F02G 1/055 165/81 |
| 3,851,472 | A * | 12/1974 | Neelen | F02G 1/053 60/517 |
| 4,004,421 | A | 1/1977 | Cowans | |
| 4,020,896 | A | 5/1977 | Mold et al. | |
| RE29,518 | E | 1/1978 | Franklin | |
| 4,077,216 | A | 3/1978 | Cooke-Yarborough | |
| 4,078,975 | A | 3/1978 | Spears, Jr. | |
| 4,078,976 | A | 3/1978 | Spears, Jr. | |
| 4,114,380 | A | 9/1978 | Ceperley | |
| 4,164,848 | A | 8/1979 | Gilli et al. | |
| 4,241,580 | A * | 12/1980 | Kitzner | 60/522 |
| 4,276,747 | A | 7/1981 | Faldella et al. | |
| 4,350,012 | A | 9/1982 | Folsom et al. | |
| 4,355,517 | A | 10/1982 | Ceperley | |
| 4,359,872 | A | 11/1982 | Martini | |
| 4,361,008 | A | 11/1982 | Dineen | |
| 4,377,400 | A | 3/1983 | Okamoto et al. | |
| 4,380,152 | A | 4/1983 | Folsom et al. | |
| 4,387,567 | A | 6/1983 | White | |
| 4,398,398 | A | 8/1983 | Wheatley et al. | |
| 4,416,114 | A * | 11/1983 | Martini | 60/526 |
| 4,418,533 | A | 12/1983 | Folsom | |
| 4,423,599 | A | 1/1984 | Veale | |
| 4,434,617 | A | 3/1984 | Walsh | |
| 4,474,233 | A | 10/1984 | Swozil | |
| 4,484,938 | A | 11/1984 | Okamoto et al. | |
| 4,489,553 | A | 12/1984 | Wheatley et al. | |
| 4,603,731 | A | 8/1986 | Olsen | |
| 4,607,424 | A | 8/1986 | Johnson | |
| 4,623,808 | A | 11/1986 | Beale et al. | |
| 4,753,072 | A | 6/1988 | Johansson et al. | |
| 4,766,013 | A | 8/1988 | Warren | |
| 4,832,118 | A | 5/1989 | Scanlon et al. | |
| 5,042,565 | A | 8/1991 | Yuen et al. | |
| 5,170,144 | A | 12/1992 | Nielsen | |
| 5,180,459 | A | 1/1993 | Bauer et al. | |
| 5,224,030 | A | 6/1993 | Banks et al. | |
| 5,281,479 | A | 1/1994 | Rittner et al. | |
| 5,301,506 | A | 4/1994 | Pettingill | |
| 5,316,080 | A | 5/1994 | Banks et al. | |
| 5,329,768 | A | 7/1994 | Moscrip | |
| 5,389,695 | A | 2/1995 | Jaster et al. | |
| 5,389,844 | A | 2/1995 | Yarr et al. | |
| 5,457,956 | A | 10/1995 | Bowman et al. | |
| 5,628,363 | A | 5/1997 | Dewar et al. | |
| 5,655,600 | A | 8/1997 | Dewar et al. | |
| 5,749,226 | A | 5/1998 | Bowman et al. | |
| 5,845,399 | A | 12/1998 | Dewar et al. | |
| 5,896,895 | A | 4/1999 | Simpkin | |
| 5,941,079 | A | 8/1999 | Bowman et al. | |
| 5,962,348 | A | 10/1999 | Bootle et al. | |
| 6,021,648 | A | 2/2000 | Zonneveld et al. | |
| 6,032,464 | A | 3/2000 | Swift et al. | |
| 6,041,598 | A | 3/2000 | Bliesner | |
| 6,263,671 | B1 * | 7/2001 | Bliesner | 60/517 |
| 6,282,895 | B1 | 9/2001 | Johansson et al. | |
| 6,314,740 | B1 * | 11/2001 | De Blok | F02G 1/043 62/467 |
| 6,516,617 | B1 | 2/2003 | Schwieger | |
| 6,526,750 | B2 | 3/2003 | Bliesner et al. | |
| 6,578,364 | B2 | 6/2003 | Corey | |
| 6,659,172 | B1 | 12/2003 | Dewar et al. | |
| 6,673,328 | B1 | 1/2004 | Klett et al. | |
| 6,701,711 | B1 | 3/2004 | Litwin | |
| 6,796,123 | B2 | 9/2004 | Lasker | |
| 6,862,883 | B2 | 3/2005 | Kamen et al. | |
| 6,913,075 | B1 | 7/2005 | Knowles et al. | |
| 6,914,025 | B2 | 7/2005 | Ekstrom et al. | |
| 6,959,753 | B1 | 11/2005 | Weber et al. | |
| 6,966,182 | B2 | 11/2005 | Kamen et al. | |
| 6,978,611 | B1 | 12/2005 | Landis | |
| 7,007,469 | B2 | 3/2006 | Bliesner | |
| 7,013,964 | B2 | 3/2006 | Pays et al. | |
| 7,051,529 | B2 | 5/2006 | Murphy et al. | |
| 7,076,941 | B1 * | 7/2006 | Hoffman et al. | 60/643 |
| 7,081,699 | B2 | 7/2006 | Keolian et al. | |
| 7,104,073 | B2 | 9/2006 | Chen et al. | |
| 7,132,161 | B2 | 11/2006 | Knowles et al. | |
| 7,284,709 | B2 | 10/2007 | Guyer | |
| 7,299,633 | B2 | 11/2007 | Murphy et al. | |
| 7,306,823 | B2 | 12/2007 | Sager et al. | |
| 7,325,401 | B1 | 2/2008 | Kesseli et al. | |
| 2002/0053422 | A1 | 5/2002 | Juslenius et al. | |
| 2003/0188856 | A1 | 10/2003 | Pays et al. | |
| 2008/0047546 | A1 | 2/2008 | Cummings | |
| 2008/0282693 | A1 | 11/2008 | Hoshino et al. | |

FOREIGN PATENT DOCUMENTS

| | | | |
|---|---|---|---|
| EP | 0996848 | B1 | 4/1998 |
| EP | 1116872 | A1 | 1/2001 |
| FR | 2503259 | A1 * | 10/1982 |
| GB | 2298903 | A | 9/1996 |
| WO | 9951069 | A2 | 10/1999 |
| WO | 9951069 | A3 | 10/1999 |
| WO | 2005013398 | A2 | 2/2005 |
| WO | 2005013398 | A3 | 2/2005 |
| WO | 2008022406 | A1 | 2/2008 |
| WO | 2008022407 | A1 | 2/2008 |

OTHER PUBLICATIONS

International Search Report, dated Mar. 5, 2012 from PCT Application No. PCT/CA2011/001256, entitled "Stirling Cycle Transducer Apparatus," filed Nov. 10, 2011.

International Preliminary Report on Patentability, dated Mar. 22, 2013 from PCT Application No. PCT/CA2011/001256, entitled "Stirling Cycle Transducer Apparatus," filed Nov. 10, 2011.

Flynn Research Inc.; Parallel Path Magnetic Technology for High Efficiency Power Generators and Motor Drives; undated document; Flynn Research, Greenwood, MO.

Knowles, T.R.; Composite Matrix Regenerator for Stirling Engines; National Aeronautics and Space Administration (NASA); Jan. 1997; Lewis Research Center, Cleveland, OH.

Meneroud, P.; Magnac, G.; Patient, F.; Claeyssen, F.; Bistable Micro Actuator for Energy Saving; Actuator 2006; P76; pp. 744-747; Jun. 14-Jun. 16, 2006; Bremen, Germany.

* cited by examiner

THERMAL ACOUSTIC PASSAGE FOR A STIRLING CYCLE TRANSDUCER APPARATUS

RELATED APPLICATIONS

This application is a 371 US National Phase of International Application No. PCT/CA2011/001256, filed 10 Nov. 2011, and claims the benefit of U.S. Application No. 61/415,196, filed 18 Nov. 2010. The entire teachings of the above applications are incorporated herein by reference.

BACKGROUND OF THE INVENTION

1. Field of Invention

This invention relates generally to transducers and more particularly to a Stirling cycle transducer for converting thermal energy into mechanical energy or for converting mechanical energy into thermal energy.

2. Description of Related Art

Stirling cycle heat engines and heat pumps date back to 1816 and have been produced in many different configurations. Potential advantages of such Stirling cycle devices include high efficiency and high reliability. The adoption of Stirling engines has been hampered in part by the cost of high temperature materials, and the difficulty of making high pressure and high temperature reciprocating or rotating gas seals. Furthermore the need for relatively large heat exchangers and low specific power in comparison to internal combustion engines has also hampered widespread adoption of Stirling engines. Specific power refers to output power per unit of mass, volume or area and low specific power results in higher material costs for the engine for a given output power.

Thermoacoustic heat engines are a more recent development, where the inertia of the working gas cannot be ignored as is often done in Stirling engine analysis. In a thermoacoustic engine designs, the inertia of the gas should be accounted for and may dictate the use of a tuned resonator tube in the engine. Unfortunately at reasonable operating frequencies the wavelength of sound waves is however too long to allow for compact engines and consequently results in relatively low specific power. Thermoacoustic engines are however mechanically simpler than conventional Stirling engines and do not require sliding or rotating high-pressure seals.

One variant of the Stirling engine is a diaphragm engine in which flexure of a diaphragm replaces the sliding pistons in conventional Stirling engines thus eliminating mechanical friction and wear. One such apparatus is disclosed in commonly owned PCT Patent application CA 2010/001092 filed on Jul. 12, 2010 and U.S. Provisional Patent application 61/213,760 filed on Jul. 10, 2009, both of which are incorporated herein by reference in their entirety. Diaphragm engines have relatively large radius compared to their height and thus accommodating radial thermal expansion of the hot side relative to the cold side may present challenges.

SUMMARY OF THE INVENTION

In accordance with one aspect of the invention there is provided a Stirling cycle transducer apparatus for converting between thermal energy and mechanical energy. The apparatus includes an expansion chamber and a compression chamber disposed in spaced apart relation along a longitudinal axis. The apparatus also includes at least one communication passage extending between the expansion chamber and the compression chamber and being operable to permit a periodic exchange of a working gas between the expansion and the compression chambers. The at least one communication passage includes an access conduit in communication with at least one of the expansion chamber and the compression chamber, and a thermal regenerator in communication with the access conduit. The regenerator is operable to alternatively receive thermal energy from gas flowing in a first direction through the communication passage and to deliver the thermal energy to gas flowing in a direction through the communication passage opposite to the first direction. The access conduit includes a compliant portion that is operable to deflect under thermally induced strains caused by an operating temperature gradient established between the expansion chamber and the compression chamber during operation.

At least one of the expansion chamber and the compression chamber may include a resilient diaphragm configured to deflect during periodic exchange of the working gas between the expansion and the compression chambers.

The apparatus may include a displacer disposed between and in communication with each of the compression chamber and the expansion chamber, the displacer being configured for reciprocating movement to vary a volume of the expansion and compression chambers during periodic exchange of the working gas.

The displacer may include a first resilient displacer wall in communication with the compression chamber, a second resilient displacer wall in communication with the expansion chamber, and at least one support extending between the first and second displacer walls, the support being operable to couple the first and second displacer walls for the reciprocating movement.

The at least one communication passage may include a plurality of communication passages each having a respective access conduit and thermal regenerator.

The plurality of communication passages may be arranged in a radial array about the longitudinal axis.

The regenerator may have a length that is less than a spacing between the expansion chamber and the compression chamber along the longitudinal axis and the regenerator length may be selected to enhance thermal energy exchange with gas flowing through the regenerator while minimizing losses due to flow friction through the regenerator and the access conduit may be configured to span a remaining portion of the spacing between the expansion chamber and the compression chamber.

The spacing between the expansion chamber and the compression chamber may be selected such that combined losses due to thermal conduction between the expansion chamber and the compression chamber and losses in the communication passage are minimized.

The access conduit may be fabricated from a material having an elastic limit and a spacing between the expansion chamber and the compression chamber may be selected to reduce stresses in the access conduit to be within the elastic limit of the material.

The access conduit may be fabricated from a material having an elastic limit and the access conduit may include at least one longitudinally oriented portion having a length dimension selected to reduce stresses in the access conduit to be within the elastic limit of the material.

The access conduit may be fabricated from a material having an elastic limit and the access conduit may include at least one generally radially oriented portion having a length dimension selected to reduce stresses in the access conduit to be within the elastic limit of the material.

The compliant portion of the access conduit may include a wall defining a bore extending through the compliant portion, the wall being dimensioned to deflect under the thermally induced strains.

The compliant portion may have a generally tubular cross section.

The compliant portion may have a flattened tubular cross section having internal height and width dimensions and the height dimension may be substantially less than the width dimension.

The compliant portion of the access conduit may include a generally longitudinally oriented portion operable to accommodate radially oriented strains, and a generally radially oriented portion operable to accommodate longitudinally oriented strains.

The compliant portion may include at least one curved portion.

The at least one communication passage may be peripherally disposed with respect to the longitudinal axis and the compliant portion may be configured to accommodate a radial offset between a first portion of the communication passage in communication with the expansion chamber and a second portion of the communication passage in communication with the compression chamber.

The regenerator may be in communication with the expansion chamber and the access conduit may extend between the regenerator and the compression chamber.

The expansion chamber and the compression chamber may define an insulating space therebetween, the insulating space having a low thermal conductivity.

The apparatus may include a low thermal conductivity insulating material disposed within the insulating space.

The insulating material may include a porous insulating material.

The insulating space may be configured to contain a gas having a lower thermal conductivity than the working gas.

A pore size of the insulating material may be smaller than a mean free path of the insulating gas.

The insulating material may include a closed cell porous material.

The communication passage may further include a first heat exchanger disposed to convey gas between the compression chamber and the regenerator, the first heat exchanger being configured to transfer heat between the gas and an external environment.

The first heat exchanger may include a plurality of high thermal conductivity carbon fibers that are spaced apart sufficiently to facilitate gas flow therethrough.

The first heat exchanger may include a compressible material in physical contact with the regenerator and the communication passage may be configured to preload the first heat exchanger and regenerator with a compression force sufficient to cause the first heat exchanger and regenerator to remain in physical contact under the thermally induced strains caused by the operating temperature gradient.

The carbon fibers may be generally oriented in a longitudinal direction for transporting heat in the longitudinal direction.

The carbon fibers may be generally disposed such that tips of at least some of the fibers are in contact with the regenerator.

The fibers may be generally disposed at an acute angle to the longitudinal axis to facilitate flexing of tips of the fibers in contact with the regenerator.

The apparatus may include a first heat conductor disposed in thermal communication with the first heat exchanger, the first heat conductor being operable to transport heat between the first heat exchanger and the external environment.

The first heat conductor may include a conduit for transporting a heat exchange fluid.

The first heat conductor may include a heat pipe.

The first heat exchanger may include a peripherally located portion in communication with the compression chamber and the regenerator may be configured to provide a plurality of generally longitudinally aligned flow paths for gas flowing through the regenerator, and peripherally disposed flow paths in the plurality of flow paths may be configured to have a greater flow resistance than inwardly disposed flow paths to promote a generally uniform gas flow through the regenerator.

The regenerator may include a matrix material operable to provide the plurality of flow paths and an interface between the first heat exchanger and the regenerator may be profiled to cause the peripherally disposed flow paths to have a greater length than the inwardly disposed flow paths.

The regenerator may include a plurality of discrete channels providing the plurality of flow paths and peripherally disposed discrete channels may have a lesser diameter than inwardly disposed discrete channels.

The first heat exchanger may include a peripheral portion in communication with the compression chamber, and the first heat exchanger may be dimensioned such that the peripheral portion is disposed beyond a peripheral extent of the regenerator to cause gas being conveyed between the compression chamber and the regenerator to flow through at least the peripheral portion of the first heat exchanger.

The first heat exchanger may include a peripheral portion in communication with the compression chamber, and the regenerator may include a blocked portion disposed proximate the peripheral portion of the first heat exchanger, the blocked portion being operable cause gas received at or discharged from the first heat exchanger to flow through at least the peripheral portion of the first heat exchanger.

The communication passage may further include a second heat exchanger disposed to convey gas between the expansion chamber and the regenerator, the second heat exchanger being configured to transfer heat between the gas and an external environment.

The second heat exchanger may include a compressible material in physical contact with the regenerator and the communication passage may be configured to preload the second heat exchanger and regenerator with a compression force sufficient to cause the second heat exchanger and regenerator to remain in physical contact under the thermally induced strains caused by the operating temperature gradient.

The second heat exchanger may include a plurality of high thermal conductivity carbon fibers.

The carbon fibers may be generally oriented in a longitudinal direction for transporting heat in the longitudinal direction.

The carbon fibers may be generally disposed such that tips of at least some of the fibers are in contact with the regenerator.

The fibers may be generally disposed at an acute angle to the longitudinal axis to facilitate flexing of tips of the fibers in contact with the regenerator.

The apparatus may include a second heat conductor disposed in thermal communication with the second heat exchanger, the second heat conductor being operable to transport heat between an external environment and the second heat exchanger.

The second heat conductor may include a thermally conductive wall.

The second heat conductor may include a heat pipe.

The second heat conductor may include a conduit for transporting a heat exchange fluid.

The second heat exchanger may include a peripherally located portion in communication with the compression chamber and the regenerator may be configured to provide a plurality of generally longitudinally aligned flow paths for gas flowing through the regenerator, and peripherally disposed flow paths in the plurality of flow paths may be configured to have a greater flow resistance than inwardly disposed flow paths to promote a generally uniform gas flow through the regenerator.

The regenerator may include a matrix material operable to provide the plurality of flow paths and an interface between the first heat exchanger and the regenerator may be profiled to cause the peripherally disposed flow paths to have a greater length than the inwardly disposed flow paths.

The regenerator may include a plurality of discrete channels providing the plurality of flow paths and peripherally disposed discrete channels may have a lesser diameter than inwardly disposed discrete channels.

The second heat exchanger may include a peripheral portion in communication with the expansion chamber, and the second heat exchanger may be dimensioned such that the peripheral portion is disposed beyond a peripheral extent of the regenerator to cause gas being conveyed between the expansion chamber and the regenerator to flow through at least the peripheral portion of the second heat exchanger.

The second heat exchanger may include a peripheral portion in communication with the expansion chamber, and the regenerator may include a blocked portion disposed proximate the peripheral portion of the second heat exchanger, the blocked portion being operable cause gas received at or discharged from the second heat exchanger to flow through at least the peripheral portion of the second heat exchanger.

The communication passage may include at least one seal that during operation of the apparatus may be subjected to an operating pressure swing due to the periodic exchange of the working gas, and may further include provisions for applying a compression force across the communication passage such that forces on the at least one seal due to the operating pressure swing may be at least partially countered by the compression force.

The provisions for providing the compression force may include a spring disposed to axially preload the communication passage.

The regenerator may have a generally cylindrical shape.

At least one of the expansion chamber and the compression chamber may include a surface along which gas flows during the periodic exchange of the working gas and the surface may include a plurality of channels formed therein, the plurality of channels being oriented to direct gas flow in the compression chamber to and from the communication passage.

The surface may include at least one of a surface of a resilient diaphragm configured to deflect to vary a volume of the compression chamber, a surface of a displacer disposed between and in communication with each of the compression chamber and the expansion chamber, the displacer being configured to move to vary the volume of the expansion and compression chambers to cause the periodic exchange of the working gas, and a surface of a wall portion of the expansion chamber opposing the surface of the displacer in communication with the expansion chamber.

The communication passage may be peripherally disposed with respect to the longitudinal axis and the plurality of channels may be oriented in a generally radial direction with respect to the longitudinal axis.

Each of the plurality of channels may include a radially oriented branch extending toward the communication passage the radially oriented branch being in communication with a plurality of angled branches disposed to feed into the radially disposed branch.

The communication passage may include a plurality of communication passages arranged in a radial array about the longitudinal axis, and each communication passage including a respective inlet in communication with the compression chamber and the plurality of channels may include at least one channel associated with each inlet for directing gas toward the respective inlet.

In accordance with another aspect of the invention there is provided a Stirling cycle transducer apparatus for converting between thermal energy and mechanical energy. The apparatus includes an expansion chamber and a compression chamber disposed in spaced apart relation along a longitudinal axis. The apparatus also includes at least one communication passage extending between the expansion chamber and the compression chamber and being operable to permit a periodic exchange of a working gas between the expansion and the compression chambers. At least one of the expansion chamber and the compression chamber includes a resilient diaphragm configured to deflect during periodic exchange of the working gas between the expansion and the compression chambers, and at least one of the expansion chamber and the compression chamber includes a surface along which gas flows during the periodic exchange of the working gas, the surface including a plurality of channels formed therein, the plurality of channels being oriented to direct gas flow in the compression chamber to and from the communication passage.

The surface along which gas flows during the periodic exchange of the working gas may include a surface of the diaphragm.

The apparatus may include a displacer disposed between and in communication with each of the compression chamber and the expansion chamber, the displacer being configured for reciprocating movement to vary a volume of the expansion and compression chambers during periodic exchange of the working gas, and the surface along which gas flows during the periodic exchange of the working gas may include a surface of the displacer.

The displacer may include a first resilient displacer wall in communication with the compression chamber, a resilient second displacer wall in communication with the expansion chamber, at least one support extending between the first and second displacer walls, the support being operable to couple the first and second displacer walls for the reciprocating movement, and the surface along which gas flows during the periodic exchange of the working gas may include a surface of at least one of the first displacer wall and the second displacer wall.

The surface along which gas flows during the periodic exchange of the working gas may include a surface of a wall portion of the expansion chamber opposing the surface of the displacer in communication with the expansion chamber.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention.

DETAILED DESCRIPTION

Figure 1:
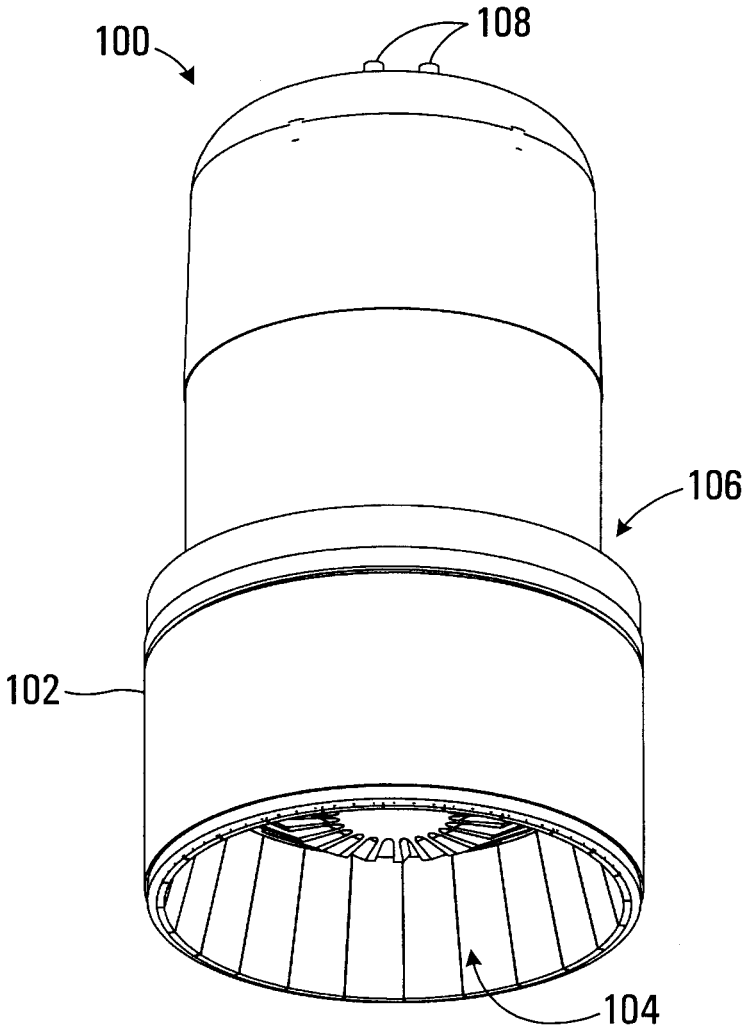
FIG. 1 is a perspective view of a Stirling cycle transducer apparatus according to a first embodiment of the invention.

Referring to FIG. 1, a Stirling cycle transducer apparatus for converting between thermal energy and mechanical energy is shown generally at 100. The apparatus 100 includes a housing 102, which encloses components of the apparatus that define a hot side 104 and a cold side 106 of the Stirling cycle transducer. The apparatus 100 further includes a pair of electrical terminals 108 providing for an electrical connection to the apparatus 100.

Figure 2:
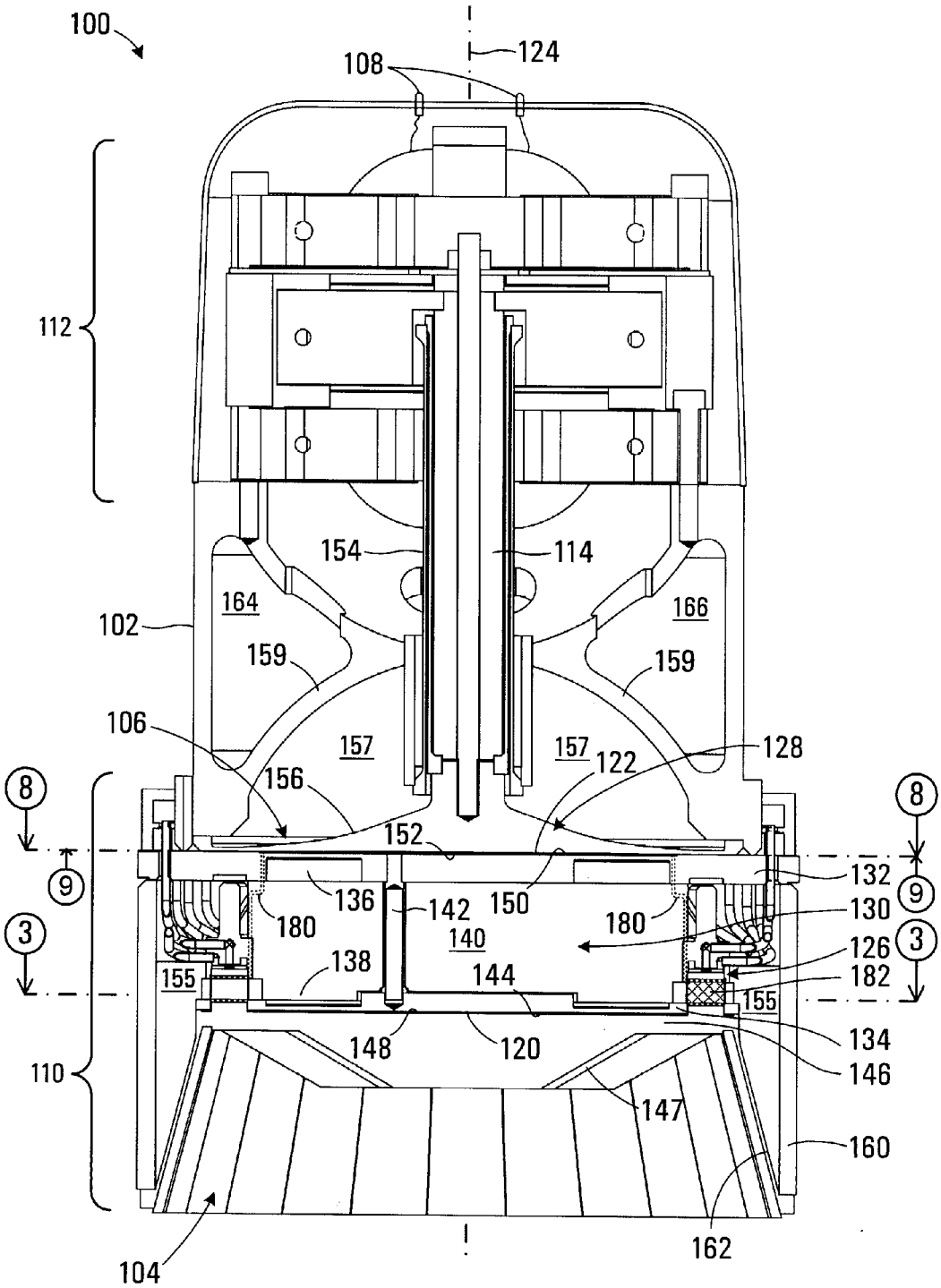
FIG. 2 is a cross-sectional view of the Stirling cycle transducer apparatus shown in FIG. 1.

The apparatus 100 is shown in cross sectional detail in FIG. 2. In the embodiment shown the apparatus 100 is configured to operate as an engine and includes a Stirling cycle transducer portion 110 and an electrical generator portion 112. The transducer portion 110 is mechanically coupled to the generator portion 112 by a drive rod 114 and the generator is electrically connected to the electrical terminals 108. In operation of the apparatus 100 as an engine, thermal energy is received at the hot side 104 and converted by the transducer portion 110 into mechanical energy. The mechanical energy is coupled to the generator portion 112 by the drive rod 114, and the generator converts the mechanical energy into electrical energy at the terminals 108, which act as an electrical power output for the engine.

In other embodiments the Stirling cycle transducer apparatus 100 may be configured as a heat pump, in which electrical energy received at the electrical terminals 108 is converted into mechanical energy by the electrical generator portion 112, acting as a motor. The mechanical energy is in turn coupled to the transducer portion 110 by the drive rod 114, and the transducer portion 110 generates a temperature gradient between the sides 106 and 104. In such an embodiment, if the side 106 is held at or close to ambient temperature, the side 104 will be cooled below ambient temperature.

Still referring to FIG. 2, the apparatus 100 includes an expansion chamber 120 and a compression chamber 122 disposed in spaced apart relation along a longitudinal axis 124. A longitudinal extent of the expansion and compression chambers 120 and 122 in the direction of the axis 124 may only be in the region of about 200 μm for example, and thus when shown generally to scale as in FIG. 2, the respective chambers are not clearly visible. The apparatus 100 also includes a communication passage 126 extending between the expansion chamber 120 and the compression chamber 122. The communication passage 126 is operable to permit a periodic exchange of a working gas between the expansion and the compression chambers 120 and 122.

The communication passage 126 includes an access conduit 180 in communication with at least one of the expansion chamber 120 and the compression chamber 122 (a pair of access conduits 180 are shown in broken lines in FIG. 2 and will be described in greater detail later herein). The communication passage 126 also includes a thermal regenerator 182 in communication with the access conduit. The regenerator 182 is operable to alternatively receive thermal energy from gas flowing in a first direction through the communication passage 126 and to deliver the thermal energy to gas flowing in a direction through the communication passage opposite to the first direction.

The transducer portion 110 further includes a resilient diaphragm 128, which is configured to deflect to vary a volume of the compression chamber 122. The diaphragm has a surface 152 oriented toward the compression chamber 122 and a second surface 156 oriented away from the compression chamber.

The working gas may be a gas such as helium or hydrogen, which occupies a working volume defined by the expansion chamber 120, the compression chamber 122, and the communication passage 126. A static pressure of working gas $P_m$ may be about 3 MPa or greater. During operation of the apparatus 100 the pressure in the working volume will swing between $P_m \pm \Delta P$, where $\Delta P$ is the differential pressure swing.

The apparatus 100 also includes a tube spring 154 coupled to the resilient diaphragm 128. The tube spring 154 provides an additional spring force in a direction generally aligned with the longitudinal axis 124, which together with the spring force provided by the resilient diaphragm 128 increases a mechanical resonance frequency of the diaphragm and the attached components of the electrical generator portion 112.

The static pressure $P_m$ of the working gas tends to cause the diaphragm 128 to be forced outwardly with respect to the compression chamber 122. The apparatus 100 also includes walls 159 within the housing 102 that together with the tube spring 154 and the surface 156 of the diaphragm 128 define a bounce chamber 157. The bounce chamber 157 contains a pressurized gas volume bearing on the surface 156 of the diaphragm 128. The gas in the bounce chamber is charged to a pressure $P_B \approx P_m$ to at least partially equalize forces on the surfaces 152 and 156 of the diaphragm 128 such that the diaphragm is not excessively deflected outwardly by the working gas static pressure $P_m$. In one embodiment a deliberate leak may be introduced between the bounce chamber 157 and the compression chamber 122 in the form of a narrow equalization conduit such as a ruby pinhole (not shown). The equalization conduit facilitates gaseous communication between the working gas and the gas volume in the bounce chamber 157. The equalization conduit may be sized to permit static pressure equalization between the working gas and the gas volume while being sufficiently narrow to prevent significant gaseous communication at time periods corresponding to an operating frequency of the transducer apparatus. The bounce chamber 157 volume, the working volume, diaphragm 128, and tube spring 154 operate together to cause the diaphragm 128 and the attached components of the electrical generator portion 112 to have a desired natural frequency. The desired frequency of operation may be at least about 250 Hz and in one exemplary embodiment may be about 500 Hz. In other embodiments the frequency of operation may be greater than 500 Hz.

The transducer portion 110 also includes a displacer 130, which is configured to move to vary the volume of the expansion and compression chambers 120 and 122 to cause the periodic exchange of the working gas between the respective chambers. In the embodiment shown, the displacer 130 includes a first resilient displacer wall 132 and a second resilient displacer wall 134. The displacer walls 132 and 134 each include respective annular cutouts 136 and 138 that facilitate resilient flexing of the displacer walls to define a central moving portion of the displacer 130, which is generally disposed between the annular cutouts. The first and second displacer walls 132 and 134 are maintained in spaced apart relation at the central moving portion by a plurality of supports 142 (only one of the supports 142 is visible in FIG. 2). The supports 142 cause portions of the first and second displacer walls 132 and 134 disposed between the annular cutouts 136 and 138 to move together as a unit during reciprocating motion of the displacer 130. In other embodiments, the support 142 may comprise a single centrally located support (not shown) extending between the first displacer wall 132 and second displacer wall 134.

The expansion chamber 120 is defined between a surface 144 of the second displacer wall 134, which forms a first wall of the expansion chamber and a surface 148 provided by the thermally conductive wall 146, which forms a second wall of the expansion chamber. The first displacer wall 132 has a surface 150 that forms a first wall of the compression chamber 122, and a surface 152 of the diaphragm 128 acts as a second wall of the compression chamber.

In the embodiment shown, movement of the diaphragm 128 and displacer 130 is a reciprocating motion in a direction aligned with the longitudinal axis 124. The reciprocating motion of the diaphragm 128 is coupled to the drive rod 114, which in turn drives the generator portion 112. The reciprocating motion of the diaphragm 128 and displacer 130 each have an amplitude that is limited by a maximum infinite fatigue stress in the diaphragm and displacer flexures. In order to provide a volume swept by the diaphragm 128 that is a substantial fraction of the working volume, while keeping bending stresses in the diaphragm low, the expansion chamber 120 and compression chamber 122 have a much larger radial extent than longitudinal height. In general, for best operating efficiency of the apparatus 100, it is desirable to keep the working volume sufficiently small so as to increase a compression ratio of the engine. Compression ratio may be defined as the ratio between a pressure amplitude due to the movement of the diaphragm 128 and displacer 130, and the working gas static pressure $P_m$. In one embodiment it is desirable to have a compression ratio of about 10%.

The apparatus also includes a thermally conductive wall 146 that forms a thermal interface between the external heat source and the transducer portion 110 of the apparatus 100 and couples thermal energy into the expansion chamber 120 for operating the apparatus 100. In the embodiment shown, the thermally conductive wall 146 includes a plurality of fins 147 for increasing a surface area of the wall in thermal communication with the external heat source (not shown). In the embodiment shown, the heat source may comprise a burner operable to generate heat through combustion of a fuel source and the thermally conductive wall 146 is configured to receive heat directly from the burner. In other embodiments, wall 146 may be coupled to receive heat indirectly from, for example, a heat pipe or a conduit carrying a heat transfer fluid.

In general, when operating the apparatus 100 as an engine, thermal energy is received from the external heat source at the thermally conductive wall 146, and heat is coupled into the working gas in the expansion chamber 120 causing an average gas temperature increase. The engine works by compressing the working gas while the average working gas temperature is generally lower and expanding the working gas while the average working gas temperature is generally higher. Compressing a colder working gas requires less work than the energy provided through expansion of the hotter working gas and the difference between these energies provides a net mechanical energy output at the diaphragm 128 which is coupled to the drive rod 114.

Insulating Material

In this embodiment, the communication passages 126 are peripherally located with respect to the longitudinal axis 124, and extend through a space between the displacer walls 132 and 134. A remaining portion of the space between the displacer walls 132 and 134 is occupied by a low thermal conductivity insulating material 140.

In one embodiment insulating space 140 is configured to facilitate introduction of an insulating gas having a lower thermal conductivity than the working gas. Advantageously the insulating gas in the insulating space 140 acts to further reduce heat conduction from the expansion chamber 120 to the compression chamber 122. The insulating gas may be pressurized to a pressure of $P_i \approx P_m$ to minimize the static pressure load on the first and second displacer walls 132 and 134. In one embodiment, the insulating material 140 may be an open cell porous material, in which case the insulating gas would permeate through the insulating material.

In other embodiments the insulating material 140 may be a closed cell porous material having entrained insulating gas within the closed cells, or a partial vacuum within the closed cells. In one specific embodiment a closed cell insulating material may have a mean pore size that is less than a mean free path of the insulating gas. The thermal conductivity of a gas is independent of pressure when the mean free path of the molecules is much less than the characteristic dimensions of the container while the mean free path is dependent on pressure. Accordingly, by charging the closed cell material such that the insulating gas pressure within the pores is sufficiently low, the mean free path of the insulating gas becomes comparable to the size of the of the container thereby dramatically reducing thermal conductivity. By selecting an insulating material 140 having closed cells that are sufficiently small such that the mean free path of the gas within the cell is larger than the cell dimensions, the thermal conductivity of the insulating material 140 may be reduced to a level approaching the performance of high vacuum insulation. For example, at common operating pressures for the apparatus 100, the required dimension for an open cell insulating material 140 would be of the order of 1 nm. In contrast for a closed cell insulating material having an insulating gas pressure within the closed cells of close to atmospheric pressure, a 10 nm cell dimension would be sufficient to achieve a sufficiently low thermal conductivity of the insulating material 140.

Advantageously, reducing conduction of heat between the expansion chamber 120 and the compression chamber 122 is generally associated with increased operating efficiency of the apparatus 100.

Communication Passages

Figure 3:
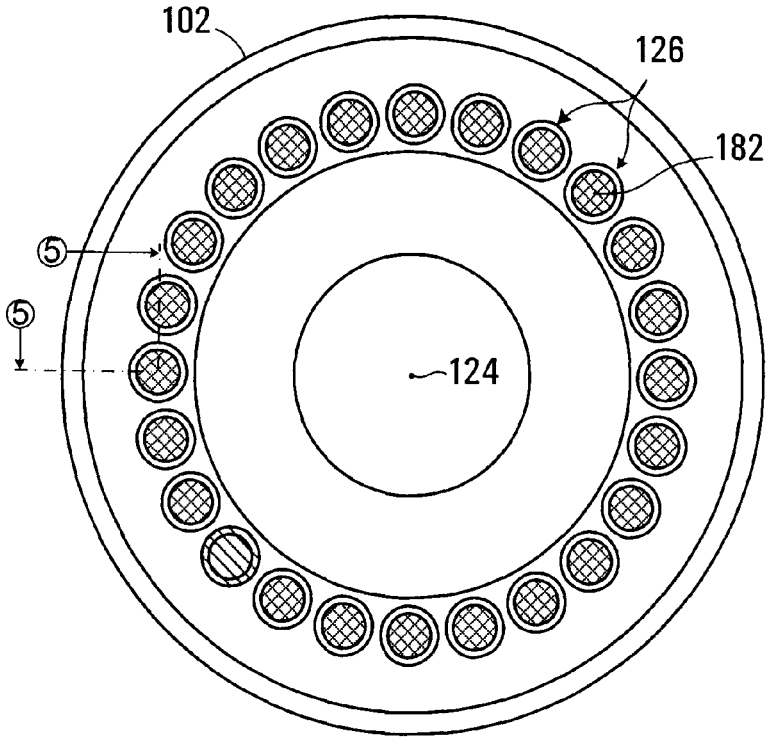
FIG. 3 is a cross-sectional view of the Stirling cycle transducer apparatus shown in FIG. 2 taken along the line 3-3.

In the embodiment shown in FIG. 2, the apparatus 100 includes a plurality of communication passages 126 (only two of which are shown in FIG. 2). A cross section taken through the apparatus 100 is shown in FIG. 3. Referring to FIG. 3 in this embodiment the communication passages 126 are generally circular and are disposed peripherally in a radial array with respect to the longitudinal axis 124. The plurality of communication passages 126 together provide for communication of the working gas between the expansion chamber 120 and the compression chamber 122.

Figure 4:
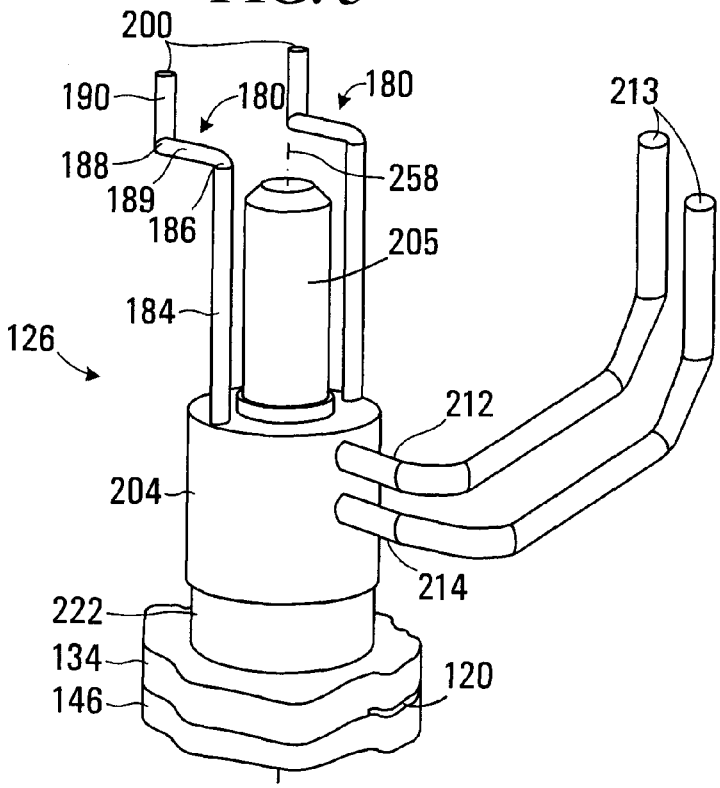
FIG. 4 is a perspective view of a communication passage included in the Stirling cycle transducer apparatus shown in FIG. 2.

One of the communication passages 126 along with a portion of the expansion chamber 120 is shown in perspective view in FIG. 4. Referring to FIG. 4, the portion of the expansion chamber 120 is defined between the second displacer wall 134 and the thermally conductive wall 146. In FIG. 4, the compression chamber 122 has been omitted for sake of clarity.

The communication passage 126 includes a cylindrical body 204 having a cylindrical axis 258. The cylindrical body 204 also includes a post 205 extending outwardly from the body in a direction generally aligned with the axis 258 (the function of the post 205 will be described later). The body 204 includes a pair of access conduits 180 extending therefrom and having respective first ends 200 for communication with the compression chamber 122 (not shown in FIG. 4). In other embodiments the second access conduit 180 may be omitted or more than two access conduits may be provided. The body 204 has a port 212 and a port 214, which are configured to carry a heat exchange fluid for transporting heat between the communication passage 126 and the external environment. The ports 212 and 214 terminate in respective openings 213 for transferring heat exchange fluid to and from an external heat exchange system (not shown).

Figure 5:
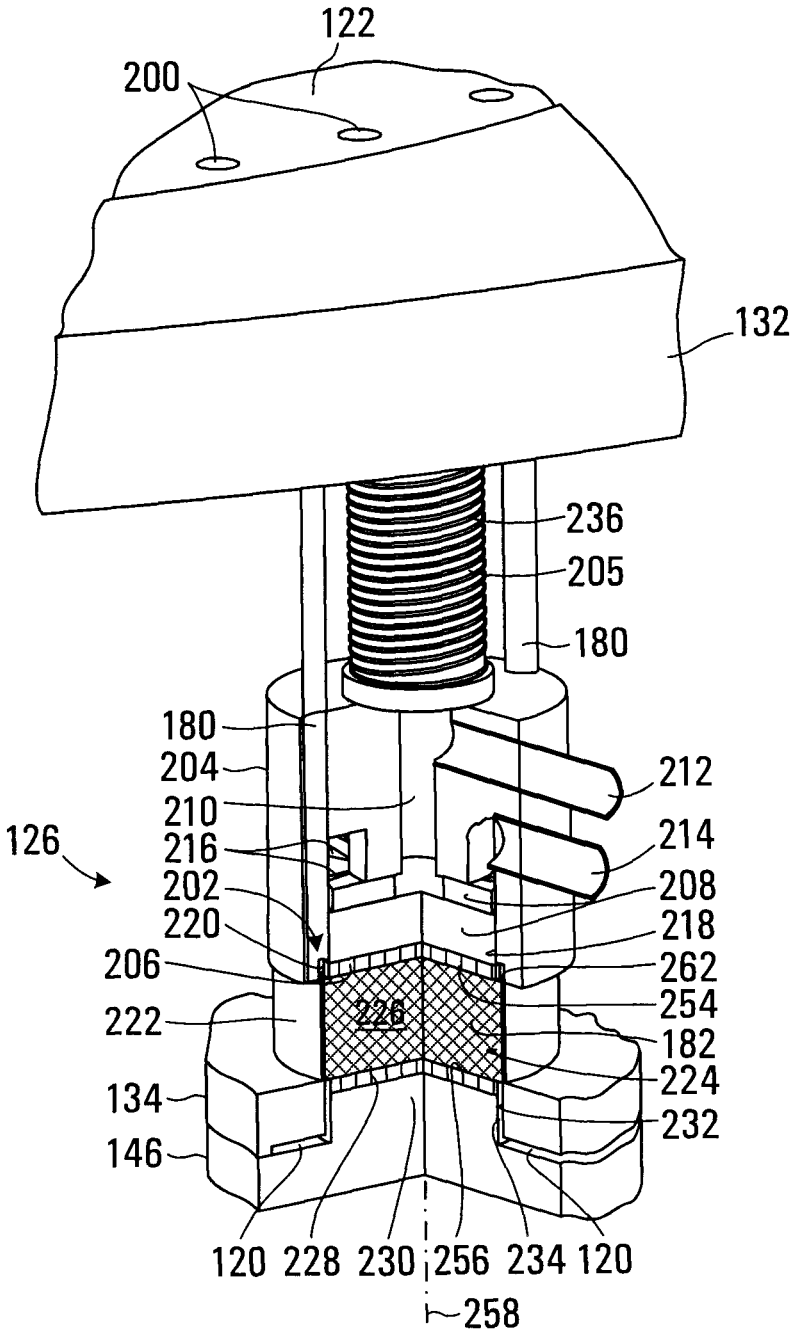
FIG. 5 is a partially cut away perspective view of the communication passage shown in FIG. 4.

The communication passage 126 is shown in partially cutaway perspective in FIG. 5. Referring to FIG. 5, a portion of the first displacer wall 132 that defines the compression chamber 122 is shown. In FIG. 5, the resilient diaphragm (128 in FIG. 2) has been omitted for sake of clarity. The access conduit 180 terminates at a second end 202 within the cylindrical body 204. The body 204 houses a first heat exchanger 206 that is disposed to convey gas flow between the access tubes 180 and the regenerator 182. The first heat exchanger includes a thermally conductive material that permits gas flow therethrough. The body 204 also houses a first heat conductor 208, disposed in thermal communication with the first heat exchanger 206. The first heat conductor 208 includes a plurality of radially oriented channels 216. The body 204 also includes a central conduit 210, which is in communication with the port 212 for receiving the heat transfer fluid, which is directed through the plurality of channels 216 and discharged through the port 214. In the embodiment shown the first heat conductor 208 comprises a high thermal conductivity metal, such as copper. In other embodiments, the first heat conductor may be coupled to transfer heat to a heat pipe.

In operation, the first heat exchanger 206 transfers heat from the working gas into the thermally conductive material, which is thermally coupled to the first heat conductor 208. The first heat conductor 208 in turn transfers the heat to the heat transfer fluid flowing through the channels 216. The heat transfer fluid is discharged through the port 214 and transports the heat out of the apparatus 100 to the external heat exchange system, and thus to the external environment.

In one embodiment the first heat exchanger 206 may comprise a carbon fiber material including high thermal conductivity carbon fibers. The carbon fiber material may be a high thermal conductivity carbon composite material. Such a composite material may be formed from carbon fibers that are electro-flocked onto a carbon veil and coated with a resin. The veil holds the fibers into a coherent whole, while the carbon fibers stick to the resin. The material is then pyrolized at very high temperature to form a so-called carbon-carbon composite. Pyrolizing causes the resin to be transformed into pure carbon, resulting in an all carbon material. The resulting structure is commonly referred to as a carbon velvet. For the first heat exchanger 206, it is desirable for the fibers to be generally oriented in a direction aligned with the longitudinal axis 124, such that heat is transferred along the fibers to the first heat conductor 208. The carbon velvet has a generally random fiber packing density allowing gas flow between the fibers while providing a large surface area for heat transfer between the gas and the fibers.

The resulting carbon composite material is then bonded to the metal heat conductor 208 using a thermally conductive paste, which after being baked in an oven results in the carbon composite material being bonded to the heat conductor. The thermally conductive paste performs a dual function of bonding the carbon composite material to the metal, as well as providing a good thermal interface for transferring heat into and out of the carbon fibers of the carbon composite material. Advantageously, the carbon composite material provides a significantly larger surface area in contact with the gas for heat transfer than could be readily provided, for example, by a metal fin heat exchanger. In other embodiments the heat exchanger may be fabricated from metal fins or pins.

Alternatively, the first heat exchanger 206 may be fabricated by electro-flocking carbon fibers onto a carrier, such as a polymer. The polymer carrying the carbon fibers is then applied to the first heat conductor 208 using thermally conductive paste. The polymer carrier, carbon fibers and first heat conductor 208 are then fired in an oven to burn off the polymer, leaving the carbon fibers bonded and thermally coupled to the first heat conductor thereby producing a carbon velvet without first producing a carbon-carbon composite. In other embodiments, the first heat exchanger 206 may be fabricated by flocking carbon fibers directly to a thermally conductive paste.

As disclosed above, in some embodiments the fibers may be oriented generally in alignment with the axis 258. Advantageously, individual carbon fibers in the carbon fiber material are generally compliant and when compressed into contact with the regenerator, the compliant fibers will flex thus providing a close physical contact between tips of the fibers and the regenerator 182. The communication passage 126 is shown schematically in cross-section in FIG. 6 and the heat exchangers 206 and 207 are shown including carbon fibers 207 and 267, which in the embodiment shown are generally oriented in alignment with the axis 258. In other embodiments, the carbon fiber material may be fabricated such that the carbon fibers are canted at an angle to the axis 258 to provide increased compliance thus further increasing the compressibility of the respective heat exchangers. In the embodiment shown in FIG. 5, the heat conductor 208 and plurality of channels 216 are fabricated in the form of a generally cylindrical disk having a diameter sized to be accommodated within a bore 218 of the cylindrical body 204. The heat exchanger 206 is also fabricated in a disk shape and is dimensioned to be accommodated in the bore 218. Advantageously, the high thermal conductivity carbon fiber materials may be pre-fabricated and cut to size to fit the bore 218, or may be fabricated to correspond to the shape of the first heat conductor 208 as detailed above.

The body 204 further includes an annular plenum 220 surrounding an outer periphery of the first heat exchanger 206. The annular plenum 220 is in communication with the end 202 of the access conduit 180. The plenum 220 acts to convey the gas between the access conduit 180 and the first heat exchanger 206.

The thermal regenerator 182 is disposed in thermal communication with the first heat exchanger 206. In embodiments where the first heat exchanger 206 comprises a high thermal conductivity carbon material as described above, the carbon fibers contact the regenerator thus providing for good thermal communication between the first heat exchanger 206 and the regenerator. The regenerator 182 may be fabricated from a matrix material 226 having a flow channel radius selected to provide sufficiently low flow friction losses while providing for efficient heat transfer between the gas flowing through the regenerator and the matrix material. In operation the regenerator matrix material 226 alternatively receives thermal energy from working gas passing through the regenerator 182 and delivers thermal energy to the working gas.

It is desirable that the matrix material 226 have a low thermal conductivity in the direction of the axis 258 to reduce heat conduction through the regenerator 182. Some examples of suitable regenerator matrix materials 226 include porous materials such a porous ceramic or packed spheres, or materials having discrete flow channels such as a as a micro capillary array. Alternatively, a stacked wire screen or wound wire regenerator, may also be used. Some suitable regenerator matrix materials are described in U.S. Pat. No. 4,416,114 to Martini, which is incorporated herein by reference in its entirety.

In the embodiment shown, the regenerator 182 is received in a thin walled sleeve 222, which in this embodiment is an integral part of second displacer wall 134. Alternatively the sleeve 222 may be welded or otherwise bonded to the second displacer wall 134. The sleeve 222 extends outwardly from the second displacer wall and has a distal end 262. A wall thickness of the sleeve 222 is selected to minimize heat conduction along the sleeve between the hot side 104 and the cold side 106, while providing sufficient structural integrity to withstand the working gas pressure swing ΔP.

The communication passage 126 also includes a second heat exchanger 228 disposed to convey gas flow between the regenerator 182 and the expansion chamber 120. The second heat exchanger 228 is in thermal communication with a second heat conductor, which in this case is provided by the thermally conductive wall 146. Heat received at the thermally conductive wall 146 from the external environment is transferred to the second heat exchanger 128, which in turn transfers the heat to the working gas.

The second heat exchanger 228 may also be formed from a high thermal conductivity carbon material, as described above in connection with the first heat exchanger 206. The thermally conductive wall 146 includes a protruding cylindrical portion 230, and the carbon material may be bonded to the protruding portion 230 using thermally conductive paste, generally as described above. For operation of the apparatus 100 at a high temperature differential, the thermally conductive paste should be capable of withstanding high temperature operation. The cylindrical portion 230 of the thermally conductive wall 146 is received within a bore 232 formed in the displacer wall 134, which is sized to define an annular plenum 234 communicating between the expansion chamber 120 and the second heat exchanger 228. In one embodiment, the annular plenum has a dimension of about 300 μm between the bore 232 and the portion 230.

The regenerator matrix material 226 is disposed in contact with the each of the first heat exchanger 206 and the second heat exchanger 228, to permit communication of working gas through the communication passage 126. In embodiments where the first and/or second heat exchangers 206 and 228 comprise a high thermal conductivity carbon material, the body 204 and the sleeve 222 are dimensioned in a direction aligned with the axis 258 such that carbon fibers of the carbon material remain in contact with the regenerator matrix under thermally induced strains that occur during operation of the apparatus 100. Advantageously, the carbon fibers of the heat exchangers 206 and 228 are somewhat compliant and are operable to bend to accommodate a slightly oversized regenerator 182 or to take up a gap associated with a slightly undersized regenerator, thereby relaxing mechanical tolerances associated with the regenerator and communication passages 126.

In general it is desirable to avoid the possibility of working gas flow reaching the regenerator matrix material 226 without exchanging sufficient heat with the material of the heat exchangers 206 and 228, thereby reducing the operating efficiency of the apparatus 100. If a gap were to open up between the carbon fibers and the regenerator matrix material 226, a significant proportion of the working gas may be able to reach the regenerator 182 without being heated or cooled by the respective heat exchangers 206 and 228. Under such conditions, the gas flowing into the regenerator 182 would be at a different temperature than the respective heat exchangers, which would reduce the effective temperature difference across the regenerator and lowers the operating efficiency of the apparatus 100. The carbon fibers of the heat exchangers 206 and 228 may also have some fiber length variation, and the communication passages may be configured and assembled such that the carbon material is in compression, thereby ensuring that a large proportion of the fibers and not only the tips of the longest carbon fibers are in contact with the regenerator 182. As disclosed above, in some embodiments, the carbon fibers may also be canted at an angle to the axis 258 to increase their compliance and thus the compressibility of the respective heat exchangers.

In one embodiment the communication passages 126 are assembled such that the first heat exchanger 206, regenerator 182, and second heat exchanger 228 are sandwiched between the first heat conductor 208 and the protruding cylindrical portion 230 of the thermally conductive wall 146. During assembly, an assembly preload is applied such that the distal end 262 of the sleeve 222 bottoms out on the body 204, such that the first and second heat exchangers 206 and 228 are urged into close contact by the preload. A length of the sleeve 222 in the direction of the axis 258 is selected such that the sleeve does not bottom out against the body 204 before providing a minimum loading between the first heat exchanger 206, the regenerator matrix material 226, and the second heat exchanger 228. While still under the assembly preload, the distal end 262 of the sleeve 222 may be sealingly bonded to the body 204 to provide a gas tight seal through the communication passage 126 between the expansion and compression chambers 120 and 122. Since this seal is only required to operate at close to ambient temperature, a material used for the body 204 may be different from the material of the sleeve 222 and the end 262 may be welded, brazed, soldered or otherwise bonded to the body. The assembly preload causes slight compression of the heat exchangers 206 and 228 such that the close contact between the heat exchangers and the regenerator matrix material 226 is maintained at the interfaces 254 and 256 under thermally induced strains that occur during operation, which may otherwise compromise the integrity of the gas flow paths through the communication passage 126 by permitting undesirable flows to bypass the heat exchangers 206 and 228.

Referring back to FIG. 5, in the embodiment shown the body 204 of the communication passage 126 is preloaded by a compression force. In this embodiment, the compression force is provided by a spring 236 that is received on the post 205 and bears against the first displacer wall 132. The compression force urges the body 204, thin walled sleeve 222, and second displacer wall 134 toward the thermally conductive wall 146. The spring is selected to provide a compression force that is sufficiently large to counter forces due to the differential operating pressure swing ΔP that would otherwise place stresses on the seal at the distal end 262 between the sleeve 222 and the body 204. Advantageously the compression force significantly reduces stresses that must be borne by the seal due to operating pressure swings.

Figure 6:
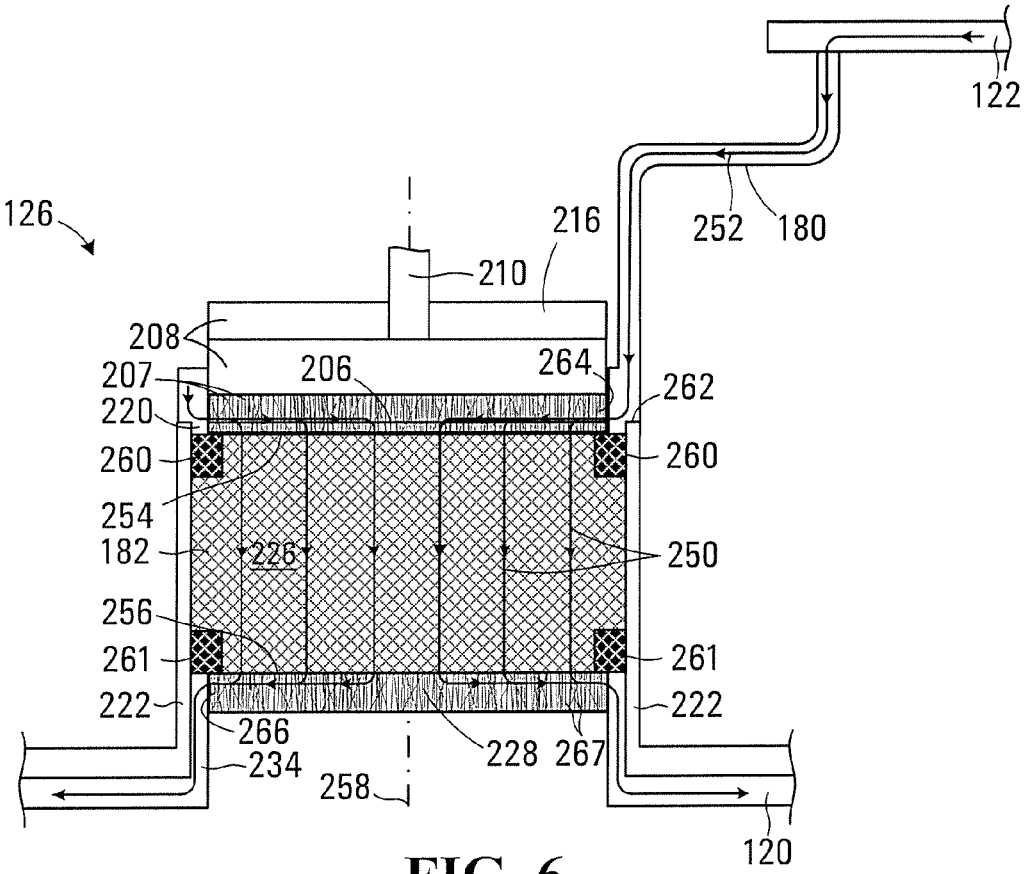
FIG. 6 is a schematic cross sectional view of the communication passage shown in FIG. 4 and FIG. 5.

Referring to FIG. 6, in the embodiment shown the matrix material 226 comprises a porous matrix, however as noted above in other embodiments the material may comprise a plurality of discrete longitudinally extending channels or micro capillaries. Gas flows through the communication passage are represented by a plurality of lines 250. In FIG. 6, flow direction is indicated by arrows 252 for flow from the compression chamber 122 to the expansion chamber 120. It should however be understood that the gas flow is periodic and the direction of the arrows 252 reverse for gas flows from the expansion chamber 120 to the compression chamber 122. In operation, when the displacer 130 and diaphragm 128 move to cause the volume of the compression chamber 122 to be reduced, gas flows from the compression chamber into each access conduit 180 associated with the communication passage 126 (only one access conduit 180 is shown in FIG. 6, however there may be more than one access conduit). Gas flows from the access conduit 180 into the annular plenum 220 undergo a change of direction from generally axial (with respect to the axis 258) to flow radially inwardly into a peripherally disposed annular portion 264 of the first heat exchanger 206. Gas flow in the first heat exchanger 206 divides to follow multiple paths toward an interface 254 between the first heat exchanger 206 and the regenerator 182. Similarly, gas flowing across a second interface 256 between the regenerator 182 and the second heat exchanger 228 undergoes a change in direction from generally axial flow in the regenerator, to generally radial flow through the second heat exchanger 228. The gas flow is discharged through a peripherally disposed annular portion 266 of the second heat exchanger 228 flows into the plenum 234. The plenum 234 channels working gas flows into the expansion chamber 120. Due to the periodic nature of the gas exchange between the expansion chamber 120 and compression chamber 122, portions of the working gas will generally shuttle back and forth within the working volume. For example, a portion of the working gas proximate the interface 254 may shuttle back and forth across the interface, without leaving the regenerator 182 or first heat exchanger 206.

In the embodiment shown in FIG. 6, the regenerator matrix material 226 of the regenerator 182 comprises a first annular blocked portion 260 and a second annular blocked portion 261 extending around a periphery of the matrix material 226. The blocked portion 260 prevents working gas from reaching peripherally disposed regenerator matrix material 226 without passing through at least the peripheral portion 264 of the first heat exchanger 206. Similarly, the blocked portion 261 prevents working gas from reaching peripherally disposed regenerator matrix material 226 without passing through at least the peripheral portion 266 of the second heat exchanger 228. In absence of the blocked portions 260 and 261, working gas would be able to reach peripheral portions of the regenerator 182 without having undergone even a minimal interaction with the first and second heat exchangers 206 and 228. The blocked portions 260 and 261 may be provided by introducing a sealing material to block capillaries or pores within the blocked portion. Alternatively, peripheral portions of the matrix material 226 may be treated to selectively block peripheral pores or capillaries, for example by firing ends of glass capillaries to melt a portion of the glass.

Figure 8:
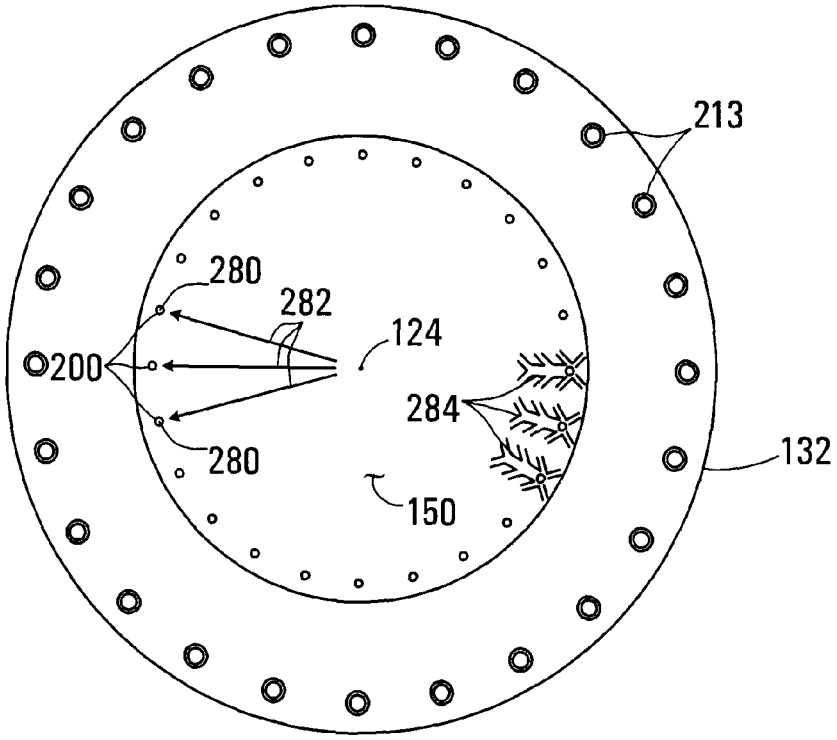
FIG. 8 is a cross-sectional view of the Stirling cycle transducer apparatus shown in FIG. 2 taken along the line 8-8.

In the embodiment of the apparatus 100 shown in FIG. 1-FIG. 3, the generally cylindrical configuration of the apparatus generally results in gas flows through the apparatus that are largely axially-symmetric with respect to the longitudinal axis 124. Accordingly, gas flow in the expansion chamber 120 and compression chamber 122 varies between being predominantly in a radially outward or radially inward direction in accordance with an operating period of the Stirling cycle. Referring to FIG. 8, the surface 150 of the first displacer wall 132 is shown in plane view and the respective first ends 200 of the access conduits 180 act as a plurality of discrete inlets 280 for gas flowing radially (represented by the arrows 282) within the compression chamber 122. The openings 213 for transferring heat exchange fluid to and from an external heat exchange system are shown for sake of completeness in FIG. 8.

Advantageously the plurality of discrete inlets 280 may be implemented by boring a plurality of openings in the displacer wall 132 for receiving the respective first ends 200 of the access conduits 180. In contrast, while an annular slot in place of the discrete inlets 280 may provide for more uniform radial flow through the compression chamber 122, such a slot may be practically difficult to implement and has some disadvantages. Such a slot would also not be able to accommodate thermal expansion due to the operating temperature differential. Additionally, an annular slot of the same free flow cross-section as the inlets 280 and access conduits 180 would suffer larger viscous losses, since the annular slot would have closely spaced walls and thus would have a smaller hydraulic radius than the access conduit portions. In general, a smaller hydraulic radius is associated with larger viscous losses. Increasing the annular spacing between walls of an annular slot would reduce flow friction, but would also result in a larger working volume. As stated above, it is desirable to keep the working volume low enough to provide for a compression ratio of order 10%, for good operating efficiency. Accordingly, perfect flow symmetry is not required and may also not be optimal.

In some embodiments, the ends 200 of the access conduits 180 may be profiled to reduce any local viscous losses due to flow concentration that may occur for gas entering or exiting the inlets 280. For example the ends 200 may be rounded into a bell mouth shape.

Thermal Expansion

For efficient operation of the apparatus 100, it is desirable to increase a temperature differential between the hot side 104 and the cold side 106. In some embodiments the temperature differential may be in the region of about 600° C. or greater. Accordingly, under operating conditions a large temperature gradient may be established between the expansion chamber 120 and the compression chamber 122. One problem associated with the large temperature differential is the associated differences in thermal expansion that must be accommodated by components and materials used in fabricating the apparatus, and particularly in components such as the regenerator that are in communication with both the hot side 104 and the cold sides 106 of the apparatus 100. Relatively large mechanical stresses may be experienced by such components during operation. Furthermore, due to the variety of different materials used in the construction of the apparatus 100, close attention needs to be paid to often significantly different rates of thermal expansion exhibited by such materials to avoid operating problems such as gas leaks or gas flow diversions from a desired flow path, for example. The expansion and compression chambers of diaphragm type Stirling engines by nature have relatively large radial dimensions and thus thermal expansion of the hot side 104 relative to the cold side 106 causes significant structural challenges when operating under high temperature differentials.

Additionally, the cylindrical configuration of the communication passage 126 provides several advantages. As disclosed above, it is desirable that the regenerator 182 have low thermal conductivity in an axial direction which causes almost the full temperature differential between the hot side 104 and the cold side 106 of the apparatus 100 to appear across the regenerator 182.

In an engine configuration, this results in the interface 254 being significantly cooler than the interface 256. One effect of the temperature differential across the regenerator 182 is that the interface 256 will tend to bow outwardly proximate the axis 258, while the peripheral edges of the interface remain in plane. The regenerator matrix material 226 at the second interface 256 undergoes thermal expansion in two dimensions resulting in the second interface bowing outwardly to take up a generally spherical shape. In the embodiment shown in FIG. 6 the regenerator matrix material 226 may be free within the sleeve 222. Alternatively, the matrix material 226 may be sealed to the sleeve only at one end, in which case the circular cross section of the regenerator 182 is advantageous, as the peripheral edges of the regenerator remain in plane when under thermal stress thus significantly simplifying sealing to the sleeve. In contrast, the inventors have found that it is significantly more difficult to seal non-circular regenerator configurations since the two dimensional thermal expansion results in peripheral edges going out of plane.

Advantageously, bowing of the regenerator matrix material 226 due to the thermal gradient does not stress the seal between the end 262 of the sleeve 222 and the body 204, and any bowing of the interface 254 is accommodated by the compliance of the carbon fibers of the first heat exchanger 206.

Furthermore, in some embodiments, the regenerator matrix material 226 may be fabricated from ceramic or glass materials, while the sleeve 222 may comprise a metal. Since ceramic or glass materials will generally have a coefficient of thermal expansion that is lower than that of the metal used in the sleeve 222, a gap will likely open up along at least a portion of the internal bore 224. Accordingly, in the embodiment shown in FIG. 5, the sleeve 222 is dimensioned such that regenerator matrix material 226 is received in a close fitting arrangement.

As disclosed above, the full temperature differential across the regenerator 182 also appears across the sleeve 222 and accordingly, the wall thickness of the sleeve is selected to be as thin as possible, consistent with the mechanical stresses that it must bear, to minimize heat conduction through the sleeve. The regenerator matrix material 226 is dimensioned to provide a generally close fit within the sleeve 222 to reduce gas flows that may occur at a periphery between the matrix material and an inner wall of the sleeve. Practically, the closeness of the fit may be determined such that a gap between the periphery of the matrix material 226 and the inner wall of the sleeve 222 has a similar hydraulic radius to the flow channels through the matrix material. For example, in the case of a porous matrix material 226, the gap may be held to a dimension in the order of the matrix pore size, which may be about 20 μm, for example, in order to avoid additional thermal and viscous losses. This criterion would also place a constraint on a maximum diameter of the regenerator 182, since it may not be possible to meet this criterion for larger diameter regenerators under some operating temperature differentials. The size of the gap between the periphery of the matrix material 226 and the inner wall of the sleeve 222 will scale with the diameter of the regenerator 182 and the temperature differential, for a given material. In one embodiment a diameter of the regenerator 182 is about 1 cm.

Figure 7:
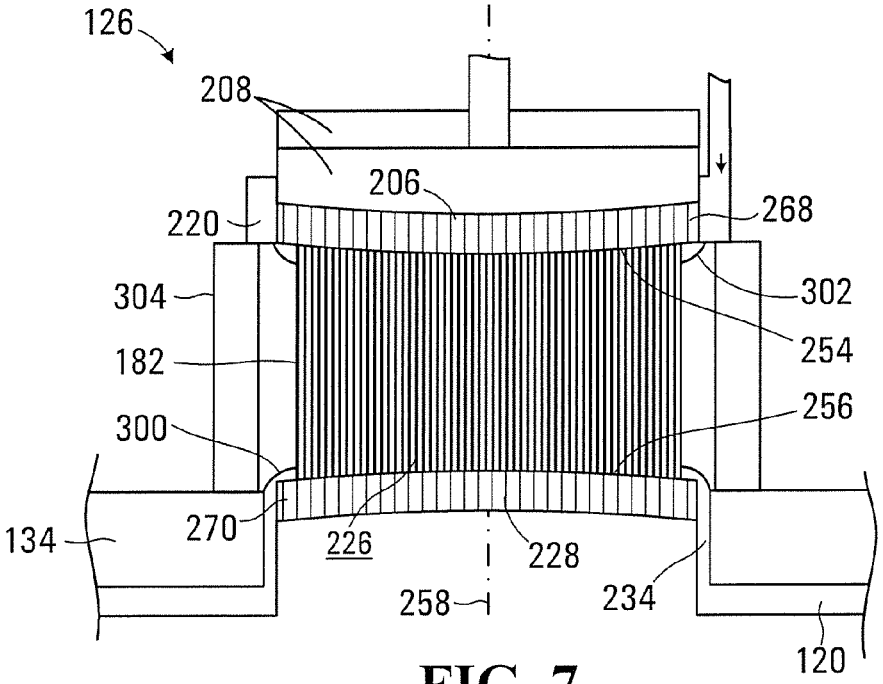
FIG. 7 is a schematic cross sectional view of an alternative embodiment of the communication passage shown in FIG. 4 and FIG. 5.

Referring to FIG. 7, in an alternative embodiment, a compliant annular high temperature seal 300 may be introduced between the matrix material 226 and the second displacer wall 134, and a compliant annular seal 302 may be introduced between the matrix material 226 and the body 204. In the embodiment shown, the seals 300 and 302 each include a thin curved metal section. In other embodiments the seal 300 may include a metal section having one or more corrugations for taking up thermal strains that occur under operating temperature differentials.

In the embodiment shown the matrix material 226 is comprised of micro capillary tubes that extend the length of the regenerator 182 and thus provide a sealed regenerator periphery. In other embodiments where the matrix material 226 is a porous matrix, the regenerator periphery may be sealed, for example by an additional sleeve (not shown). Advantageously, the cylindrical configuration of the regenerator 182 that causes the peripheral edges of the matrix material 226 to remain in plane under the operating temperature differential also helps to accommodate differential expansion by reducing the demands on the annular seals 300 and 302 and the seal need only accommodate in plane radial expansion of the peripheral edge of the regenerator 182. In the embodiment shown, the communication passage 126 further includes an insulator 304 extending between the body 204 and the second displacer wall 134. The insulator 304 is configured to bear the compression load due to the spring 236 which may otherwise cause the carbon fiber of the heat exchangers 206 and 228 or regenerator matrix 226 to be crushed. In one embodiment the insulator 304 comprises a porous ceramic material.

In the embodiment shown, the matrix material 226 has a profiled shape at the interface 254 and at the interface 256. In this embodiment, the shape of the interfaces 254 and 256 is concave and has a generally spherical profile, but in other embodiments the interfaces 254 and 256 may have a non-spherical profile depending on actual flow paths 250 through the communication passages 126.

In general, the profiled interfaces 254 and 256 provide for a shorter path length through the regenerator matrix material 226 proximate the axis 258 of the regenerator 182 then at a periphery of the regenerator. The profile of the interfaces 254 and 256 may be selected to substantially equalize the flow resistance of all paths through the regenerator 182. The shorter path through the regenerator proximate the axis 258 at least partially offsets the longer path that the gas must travel through the first heat exchanger 206 and second heat exchanger 228, such that all flow paths through the combined first heat exchanger, regenerator 182, and second heat exchanger have a generally similar fluidic flow resistance. Advantageously, providing the profiled interfaces 254 and 256 causes a more uniform gas flow through the matrix material 226, which contributes toward increasing operating efficiency of the apparatus 100. Promoting a uniform flow through the matrix material 226 is particularly important in embodiments having a matrix material 226 that provides for limited flow redistribution in a lateral direction with respect to the axis 258, as in the case of the micro capillary matrix material shown in FIG. 7. In contrast, porous matrix materials (such as shown in FIG. 6) generally permit at least some flow redistribution in lateral directions with respect to the axis 258, and in such cases profiling of the interface may not be required or the profiling may be less pronounced than for a micro capillary array matrix material. Accordingly, profiling of the interfaces 254 and 256 may be more pronounced, less pronounced, or completely omitted, depending on the particular configuration and matrix material selected for the regenerator 182.

Alternatively, in other micro capillary regenerator embodiments (not shown), a hydraulic radius of micro capillary tubes located proximate the central axis 258 may be made slightly larger than tubes located away from the axis in order to substantially equalize the flow resistance through different portions of the regenerator 182.

In the embodiment shown in FIG. 7, the first and second heat exchangers are extended outwardly to have a larger diameter than the regenerator matrix material 226. The first heat exchanger 206 has an annular portion 268 and the second heat exchanger 228 has an annular portion 270 that respectively extend beyond a peripheral edge of the regenerator 182. The outwardly extending portions 268 and 270 cause working gas received at or discharged from the first and second heat exchangers 206 and 228 to flow through at least these portions of the respective heat exchangers before flowing across the interfaces 254 and 256, and thus provide for a minimum interaction between the working gas and the heat exchangers 206 and 228. In other embodiments a blocked portion similar to the annular blocked portion 260 (shown in FIG. 6) may be implemented instead of, or in addition to the extended portions 268 and 270 to increase the interaction of the working gas with the first and/or second heat exchangers. For a micro capillary regenerator matrix material 226, only a single blocked portion would be required to block flow through the capillaries and this portion may advantageously be located at the cold side of the regenerator (i.e. at the same location of the blocked portion 260 shown in FIG. 6). This facilitates use of a low temperature sealing material and also reduces additional heat conduction that would occur through the capillaries if the blocked portion were to be further extended as shown in the porous matrix regenerator embodiment of FIG. 6.

Compliant Access Conduits

As disclosed above, the communication passages 126 are urged into contact with the second displacer wall 134 and thus the hot side 104 of the apparatus by the compression force provided by the spring 236. During operation, thermal expansion may cause the first displacer wall 132 and second displacer wall 134 to move longitudinally relative to each other thus placing a thermal strain on the communication passages 126, which have the respective ends 200 of the access conduits 180 coupled to the first displacer wall 132. However thermal strains are also introduced in a radial direction (i.e. generally perpendicular to the longitudinal axis 124), and these radial strains may be greater than the longitudinal strains. Radial strains originate due to thermal expansion of the second displacer wall 134 and the thermally conductive wall 146 of the expansion chamber 120 relative to the first displacer wall 132 of the compression chamber 122.

Referring back to FIG. 4, in the embodiment shown, each of the access conduits 180 include a first generally longitudinally oriented portion 184 extending outwardly from the body 204 and first and second curved portions 186 and 188 that define a generally radially oriented portion 189. A second generally longitudinally oriented portion 190 extends from the second curved portion 188 and terminates at the first end 200.

The first longitudinal portion 184 accommodates radial strains by flexing along its length, which places a stress on the walls of this portion of the access conduit 180. In one embodiment, the access conduits 180 are fabricated from thin walled tubular stainless steel, which is structurally capable of withstanding the working gas pressure swings while simultaneously being dimensioned to deflect under the thermally induced strain. The access conduits 180 will have an associated maximum stress limit for elastic flexing of the conduit walls. Under conditions that cause a maximum radial expansion of the apparatus 100, the stress on the walls will be at a maximum, and the length of the longitudinal portion is selected to reduce these wall stresses below a maximum stress limit associated with the material.

Similarly, the radial portion 189 accommodates longitudinal strains by flexing along its length, thus placing a stress on the walls of this portion of the access conduit 180. Under maximum longitudinal displacement conditions, the stress on the walls will be at a maximum, and the length of the radial portion is selected to reduce these wall stresses below the maximum stress limit associated with the access conduit material.

In one embodiment the access conduit 180 may have a generally uniform wall thickness along its length, while in other embodiments the wall thickness may be reduced to increase the compliance of portions of the access conduit that are required to flex to accommodate the thermal strains. In other embodiments, the access conduits 180 may include additional loops or curves to accommodate the longitudinal and/or radial strains. While in the embodiment shown in FIG. 4, the access conduits 180 have a generally circular cross section, in other embodiments the conduits may be flattened or may have flattened portions having greater width than height to cause the conduit have a preferential flexing direction. The flattened access conduit would be oriented such that the preferential flexing direction is aligned to take up the strains that occur due to the operating temperature differential. The internal dimensions of the conduit may be selected to provide an equivalent flow friction for gas flowing through the conduit.

The overall length of the access conduit 180 is constrained by viscous and thermal relaxation losses, which are proportional to length. Furthermore, additional length of the access conduits increases the working volume of the apparatus 100, which reduces the achievable compression ratio. While increased spacing between the displacer walls 132 and 134 generally increases operating efficiency, at some point increasing the spacing further no longer compensates for these losses associated with the access conduits 180. Accordingly, it is advantageous to dimension the access conduit 180 such that a length of the conduit is no longer than required to accommodate the maximum thermally induced strains. In one embodiment, the length and configuration of the access conduits 180 are selected such that under ambient temperature the stress is of generally equal magnitude but of opposite sign to the stress that would be encountered at operating temperatures. Such a pre-stressed configuration advantageously permits a shorter length of access conduit than would otherwise be required. Accommodating the radial and longitudinal thermal strains without exceeding a stress limit in the access conduits 180 sets a lower limit on the spacing between first displacer wall 132 and the second displacer wall.

In general, the length of the regenerator 182 in the direction of the longitudinal axis 124 (shown in FIG. 2) is constrained by considerations related to gas flow friction through the regenerator matrix material 226. Generally the desired spacing between the first displacer wall 132 and second displacer wall 134 for reducing thermal conduction between the hot side 104 and cold side 106 is greater than an optimal length of the regenerator 182. Advantageously, the access conduits 180 span the additional spacing and thus provide for an increased spacing between the first displacer wall 132 and second displacer wall 134 beyond that which would be provided in a configuration where the regenerator occupied most of the spacing between the walls. This increased spacing accommodates an increased thickness of insulating material between the displacer walls 132 and 134, providing enhanced thermal isolation between the hot side 104 and cold side 106 of the apparatus 100.

Referring back to FIG. 3, additionally in the embodiments shown the plurality of communication passages 126 permit each passage to move relative to its' neighboring passage to accommodate the longitudinal and radial thermally induced strains. Advantageously, configuring the apparatus 100 to include a plurality of discrete communication passages 126 as in the disclosed embodiments together with the compliant access tubes 180 provides for relative motion in both the radial and longitudinal directions without producing excessive mechanical stresses between the cold side 106 and hot side 104 of the apparatus 100. Advantageously, reducing these thermally induced mechanical stresses facilitates repeated thermal cycling of the apparatus 100, while maintaining the structural integrity of the gas seals.

In the embodiments shown herein the regenerator 182 is generally in communication with the expansion chamber 120 via the second heat exchanger 228. However in other embodiments, the regenerator 182 and access conduits 180 may be otherwise configured such that the regenerator is instead in communication with the compression chamber 122. In yet another embodiment the regenerator 182 may be disposed between two access conduit portions, or the regenerator may be split into more than one regenerator portion, each separated by a portion of access conduit between the regenerators.

Advantageously, the communication passages 126 facilitate thermal expansion during operation within the stress limits of materials making up the apparatus 100 and without placing significant stress on seals required to contain the working gas and to channel gas flows between the expansion and compression chambers 120 and 122. Furthermore, the use of communication passages 126 also reduces the need to maintain tight dimensional tolerances for most of the components making up the apparatus 100.

In one embodiment, the second displacer wall 134 and thermally conductive wall 146 defining the expansion chamber 120 may be fabricated from a material capable of withstanding high temperatures, such as inconel. The first displacer wall 132 and diaphragm 128 defining the compression chamber 122 may be fabricated from alloy steel. Radial expansion of the expansion chamber 120 will occur due to the operating temperature differential, while the compression chamber 122, which remains near ambient temperature, does not expand significantly. This results in some strain being placed on the plurality of supports 142 (shown in FIG. 2) coupling the first and second displacer walls 132 and 134. However, in the embodiment shown in FIG. 2, the supports 142 are located proximate the central moving portion of the second displacer wall 134 and therefore undergo smaller lateral thermally induced displacement than peripheral portions of the wall, which are not mechanically constrained.

Pressure Vessel

Referring back to FIG. 2, as disclosed above the working volume of the apparatus 100 includes the volume of the expansion chamber 120, the volume of each of the plurality of communication passages 126, and the volume of the compression chamber 122. Also as disclosed above, the low thermal conductivity insulating material 140 may be pressurized by an insulating gas to a pressure of $P_i \approx P_m$ to minimize the static pressure load on the first and second displacer walls 132 and 134. In the embodiment shown, there are additional insulating regions 155 that lie within the housing 102, but are outside of the working volume or the bounce chamber 157. These regions 155 may be in communication with the low thermal conductivity insulating material, and would thus also be pressurized to a static pressure that is generally equivalent to the static working pressure $P_m$. Pressurized regions of the apparatus 100 are generally defined between walls 159, 160, 162, the thermally conductive wall 146, and the tube spring 154 and define a pressure vessel within which the Stirling cycle transducer portion 110 operates. The pressure vessel is internally subdivided into three regions, the working gas space 120, 122, 126, the bounce space 157 and the insulating space 140, 155. The three regions may optionally be isolated from each other and pressurized with different gasses to similar pressures or else weakly connected and pressurized with the same gas to the same pressure or combinations of the above. Other volumes within the housing 102, such as volumes 164 and 166 may be un-pressurized or evacuated. With the bounce space and insulating spaces pressurized most of the structure that defines the working volume (i.e. the diaphragm 128, the first displacer wall 132, second displacer wall 134, and the communication passages 126) are not required to withstand the full working pressure $P_m$, but are rather only subjected to the differential operating pressure swing $\Delta P$. The differential operating pressure swing $\Delta P$ may have an amplitude of about 10% of the static working pressure $P_m$. Accordingly, these structures that define the working volume need only withstand about 10% of $P_m$.

One exception is the thermally conductive wall 146, which forms an external wall of the pressure vessel and must thus withstand the full working pressure and operating pressure swing (i.e. $P_m+\Delta P$). The thermally conductive wall 146 however is not required to flex during operation as is the diaphragm 128, and accordingly may be made sufficiently thick to withstand the pressure.

Dendritic Channels

Figure 9:
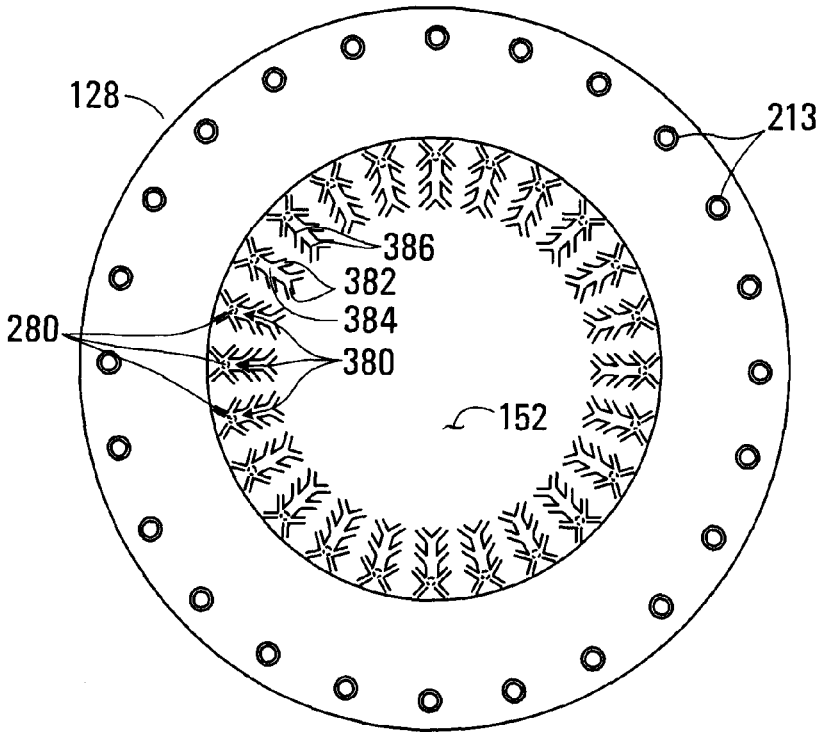
FIG. 9 is a cross-sectional view of the Stirling cycle transducer apparatus shown in FIG. 2 taken along the line 9-9.

As disclosed above, gas flow within the expansion chamber 120 and compression chamber 122 is generally oriented in a radial direction and, due to the limited longitudinal extent of the expansion and compression chambers occurs in close proximity to the surface 144 and surface 148 defining the expansion chamber and the surface 150 and surface 152 defining the compression chamber 122. Accordingly, the periodic exchange of the working gas between the expansion and compression chambers 120 and 122 is also associated with viscous losses within the chambers. Referring to FIG. 9, in the embodiment shown the diaphragm 128 includes a plurality of channels 380 formed in the surface 152 of the diaphragm. In one embodiment the channels 380 may be pressed into the surface 152 using a die.

The channels 380 are oriented to direct gas flow in the compression chamber to the plurality of discrete inlets 280 (which are in the first displacer wall 132 as defined by the ends 200 of the access conduits 180). The channels provide a wider channel for gas flow in the region of the plurality of discrete inlets 280, thus lowering viscous losses. The channels 380 are generally radially oriented and are relatively shallow. In the embodiment shown in FIG. 9 the channels 380 have a tree-like structure having smaller branches 382, which are both narrower and shallower leading the gas flow to one or more main channels or trunks 384 ending in proximity to the inlets 280. The tree structure shown in FIG. 9 is provided for an embodiment having about 24 inlets 280, however in other embodiments a dendrite structure having a greater number of and longer branches may be implemented. In general, it is desirable that the channels 380 have rounded corners 306 to minimize local viscous losses for gas entering or leaving the channel. A depth of the main channel 384 may be made similar to its width in order to minimize viscous losses. In one embodiment the depth of the main channel 384 is about 1 mm.

Advantageously, the channels 380 lower viscous losses for gas flows within compression chamber 122 and facilitate a closer spacing between surface 152 of the diaphragm 128 and the surface 150 of the first displacer wall 132 that would be otherwise possible due to the constraint of viscous losses. This facilitates a further reduction of working volume, and therefore a commensurate increase in compression ratio. The channels 380 are also disposed near the periphery of the diaphragm 128, in a region where it is desirable to minimize the chamber height since a significant fraction of the volume of the compression chamber 122 (and the expansion chamber 120) is located at the periphery. The periphery of the compression chamber 122 (and the expansion chamber 120) is also a region where largest gas flows occur and thus is a source of most of the viscous losses due to this flow.

Similarly, referring back to FIG. 8, corresponding shallow channels 284 may be formed in the first displacer wall 132 (only one channel 284 is shown in FIG. 8). If there are matching channels in the diaphragm and the facing surface 150 of the first displacer wall then the total depth of the two channels should be similar to the width of the channels. Similar channels may also be formed in the second displacer wall 134 and the thermally conductive wall 146 defining the expansion chamber 120.

While a specific configuration of the channels 380 is shown in FIG. 8, in other embodiments the channels may be otherwise configured and may have more or less branches and/or trunks having similar or different layout to that shown.

While specific embodiments of the invention have been described and illustrated, such embodiments should be considered illustrative of the invention only and not as limiting the invention.

What is claimed is:

1. A communication passage for use in a Stirling cycle transducer, the communication passage comprising:

a thermal regenerator having a cylindrical shape and having first and second interfaces for receiving a periodic gas flow, the regenerator providing a plurality of flow paths operable to permit gas flow between the first and second interfaces in a direction generally aligned with a cylindrical axis of the regenerator, the regenerator being configured to alternatively receive thermal energy from gas flowing in a first axially oriented flow direction along the flow paths and to deliver thermal energy to gas flowing in a second opposing axially oriented flow direction along the flow paths;

a first heat exchanger disposed in communication with one of the first interface and the second interface and being configured to convey gas flow in a generally transverse oriented flow direction with respect to the cylindrical axis and to permit the gas flow to undergo a change of direction between the transverse oriented flow direction proximate the one of the first interface and the second interface and the first and second axially oriented flow directions within the regenerator; and a thermally conductive wall disposed in thermal communication with the first heat exchanger, the thermally conductive wall being configured to transfer heat in a direction generally aligned with the cylindrical axis of the regenerator.

2. The communication passage of claim 1 wherein the first heat exchanger comprises a plurality of high thermal conductivity fibers that are spaced apart sufficiently to facilitate gas flow therethrough.

3. The communication passage of claim 2 wherein the first heat exchanger comprises a compressible material in physical contact with the first interface of the regenerator and wherein the communication passage is configured to preload the first heat exchanger and regenerator with a compression force sufficient to cause the first heat exchanger and regenerator to remain in physical contact under the thermally induced strains caused by an operating temperature gradient established during operation of the Stirling cycle transducer.

4. The communication passage of claim 2 wherein the fibers are generally oriented in a direction aligned with the axially oriented gas flow for transporting heat in the axially oriented direction.

5. The communication passage of claim 2 wherein the fibers are generally disposed such that tips of at least some of the fibers are in contact with the first interface of the regenerator.

6. The communication passage of claim 5 wherein the fibers are generally disposed at an acute angle to the axially oriented direction to facilitate flexing of tips of the fibers in contact with the first interface of the regenerator.

7. The communication passage of claim 1 wherein the thermally conductive wall is in thermal communication with a conduit for transporting a heat exchange fluid.

8. The communication passage of claim 1 wherein the thermally conductive wall in in thermal communication with a heat pipe.

9. The communication passage of claim 1 wherein peripherally disposed flow paths in the plurality of flow paths are configured to have a greater flow resistance than inwardly disposed flow paths to promote a generally uniform gas flow in the regenerator.

10. The communication passage of claim 9 wherein the regenerator comprises a matrix material operable to provide the plurality of flow paths and wherein at least one of the first and second interfaces is profiled to cause the peripherally disposed flow paths to have a greater length than the inwardly disposed flow paths.

11. The communication passage of claim 9 wherein the regenerator comprises a plurality of discrete channels providing the plurality of flow paths and wherein peripherally disposed discrete channels have a lesser diameter than inwardly disposed discrete channels.

12. The communication passage of claim 1 wherein the regenerator comprises a blocked portion disposed proximate a periphery of at least one of the first and second interfaces, the blocked portion being operable to cause gas received at or discharged from the heat exchanger in communication with the one of the first interface and the second interface to flow through at least a peripheral portion of the heat exchanger before reaching the interface.

13. The communication passage of claim 1 wherein the communication passage comprises at least one seal that during operation of the apparatus is subjected to an operating pressure swing, and further comprising means for applying a compression force across the communication passage such that forces on the at least one seal due to the operating pressure swing are at least partially countered by the compression force.

14. The communication passage of claim 13 wherein the means for providing the compression force comprises a spring disposed to axially preload the communication passage.

15. The communication passage of claim 1 further comprising an access conduit in communication with a peripherally located portion of the first heat exchanger, the access conduit comprising a compliant portion that is operable to deflect under thermally induced strains caused by an operating temperature gradient established during operation of the Stirling cycle transducer.

16. The communication passage of claim 15 wherein the compliant portion of the access conduit comprises a wall defining a bore extending through the compliant portion, the wall being dimensioned to deflect under the thermally induced strains.

17. The communication passage of claim 15 wherein the compliant portion comprises a tubular cross section.

18. The communication passage of claim 15 wherein the compliant portion comprises a flattened tubular cross section having internal height and width dimensions and wherein the height dimension is substantially less than the width dimension.

19. The communication passage of claim 1 wherein the regenerator is disposed within a thin walled cylindrical sleeve and sealingly bonded to the sleeve proximate one of the first and second interfaces to facilitate expansion of the regenerator within the sleeve when subjected to an operating temperature gradient.

20. A thermal regenerator apparatus for use in a Stirling cycle transducer, the apparatus comprising a plurality of communication passages each configured as in claim 1 and disposed to receive a portion of a fluid flow established during operation of the Stirling cycle transducer.

21. The communication passage of claim 1 wherein the first heat exchanger is disposed in communication with the first interface and further comprising a second heat exchanger disposed in communication with the second interface and being configured to convey gas flow in the generally transverse oriented flow direction and to permit the gas flow to undergo a change of direction between the transverse oriented flow direction proximate the second interface and the first and second axially oriented gas flow directions within the regenerator, a thermally conductive wall disposed in thermal communication with the second heat exchanger, the thermally conductive wall being configured to transfer heat in a direction generally aligned with the cylindrical axis of the regenerator.

22. The communication passage of claim 21 wherein the second heat exchanger comprises a compressible material in physical contact with the second interface of the regenerator and wherein the communication passage is configured to preload the first heat exchanger and regenerator with a compression force sufficient to cause the second heat exchanger and regenerator to remain in physical contact under the thermally induced strains caused by an operating temperature gradient established during operation of the Stirling cycle transducer.

23. The communication passage of claim 22 wherein the second heat exchanger comprises a plurality of high thermal conductivity fibers that are spaced apart sufficiently to facilitate gas flow therethrough.

24. The communication passage of claim 23 wherein the fibers are generally oriented in a direction aligned with the axially oriented gas flow for transporting heat in the axially oriented direction.

25. The communication passage of claim 23 wherein the fibers are generally disposed such that tips of at least some of the fibers are in contact with the regenerator.

26. The communication passage of claim 25 wherein the fibers are generally disposed at an acute angle to the axially oriented direction to facilitate flexing of tips of the fibers in contact with the first interface of the regenerator.

27. The communication passage of claim 21 wherein the thermally conductive wall is in thermal communication with a heat pipe.

28. The communication passage of claim 21 wherein thermally conductive wall is in thermal communication with a conduit for transporting a heat exchange fluid.

29. The communication passage of claim 2 wherein the plurality of high thermal conductivity fibers comprise a plurality of carbon fibers.

30. The communication passage of claim 23 wherein the plurality of high thermal conductivity fibers comprise a plurality of carbon fibers.

31. A Stirling cycle transducer comprising:

a pressure vessel providing an enclosed pressurized volume;

at least one communications passage according to claim 1, wherein the communications passage forms a portion of a working volume of the Stirling cycle transducer and wherein the pressure vessel encloses the working volume within the pressurized volume.

* * * * *